US007013699B1

(12) United States Patent
Sperko

(10) Patent No.: US 7,013,699 B1
(45) Date of Patent: Mar. 21, 2006

(54) PIPE FITTING TOOL AND METHOD

(76) Inventor: Walter J. Sperko, 4803 Archwood Dr., Greensboro, NC (US) 27406

( * ) Notice: Subject to any disclaimer, the term of this patent is extended or adjusted under 35 U.S.C. 154(b) by 0 days.

(21) Appl. No.: 10/812,483

(22) Filed: Mar. 30, 2004

(51) Int. Cl.
*B21D 19/10* (2006.01)

(52) U.S. Cl. ..... 72/409.19; 72/414; 72/370.1

(58) Field of Classification Search ..... 72/409.01, 72/409.1, 409.12, 409.19, 414, 370.04, 370.1
See application file for complete search history.

(56) References Cited

U.S. PATENT DOCUMENTS

| | | | | |
|---|---|---|---|---|
| 1,300,495 | A * | 4/1919 | Shank | 72/409.01 |
| 2,314,884 | A * | 3/1943 | Klein | 72/409.01 |
| 2,342,089 | A * | 2/1944 | Rossmann | 72/454 |
| 2,836,089 | A * | 5/1958 | Davies | 72/409.1 |
| 3,244,201 | A * | 4/1966 | Wallshein | 72/409.01 |
| 3,375,693 | A | 4/1968 | Hougen | |
| 3,624,876 | A | 12/1971 | Irvin | |
| 3,998,376 | A | 12/1976 | Haines | |
| 4,158,955 | A | 6/1979 | Bustin | |
| 4,286,372 | A | 9/1981 | Batcheller | |
| 4,318,291 | A | 3/1982 | Thompson | |
| 4,470,291 | A | 9/1984 | Gibb | |
| 4,523,780 | A | 6/1985 | Cheer | |
| 4,531,397 | A | 7/1985 | Pratt | |
| 5,071,174 | A | 12/1991 | Griffin et al. | |
| 5,287,716 | A * | 2/1994 | Szulc | 72/409.12 |
| 5,810,054 | A | 9/1998 | Goulet et al. | |
| 6,269,674 | B1 | 8/2001 | Sperko | |

FOREIGN PATENT DOCUMENTS

| | | |
|---|---|---|
| FR | 1085076 | 1/1955 |
| GB | 2671 | 0/1888 |
| GB | 362330 | 12/1931 |
| GB | 1250362 | 10/1971 |

OTHER PUBLICATIONS

T-Drill Industries, Inc. brochure; six (6) pages; Oct. 4, 1993.

* cited by examiner

*Primary Examiner*—David Jones

(57) ABSTRACT

The invention herein illustrates a tool and method for use in joining pipes or other tubular fittings having different diameters in a telescopic type joint. The preferred tool provides a pair of dimples or marks on one of the pipes to obstruct insertion as one pipe is slid into another. The obstruction thus provides a uniform overlap of the pipes to ensure sufficient surface area for the material used in the joining process, such as a brazing metal. Overlapping uniformity provides a strong, durable joint. The tool includes a pair of jaws which can be closed along the wall of the tubular member to form for example, a pair of dimples therein. In an alternate embodiment of the pipe fitting tool only one dimple is formed in the pipe wall from a single ram.

10 Claims, 9 Drawing Sheets

PIPE FITTING TOOL AND METHOD

FIELD OF THE INVENTION

The invention herein pertains to joining and fitting pipes and particularly pertains to a tool used to place dimples and marks in the walls of the pipes for observation during fitting and inspection and to ensure a strong, secure joint.

DESCRIPTION OF THE PRIOR ART AND OBJECTIVES OF THE INVENTION

Pipes, tubes, fittings and the like are usually joined by inserting one pipe having a small diameter with sufficient depth into a larger diameter pipe and then soldering or brazing the joined pipes, so a strong, durable joint is formed. U.S. Pat. No. 6,269,674 describes a tool used in this process. In controlled conditions such as in a factory, the joints can be uniformly made, and are consistent and dependable. However, when working at a job site many times the conditions are adverse due to weather, available lighting and other factors. Joints formed under these conditions may prematurely rupture, causing fluid escape, danger to persons nearby and requires expensive labor to refit and repair the pipe. Also, pipe inspectors often cannot determine the depth of overlap between two (2) joined pipes, thus rendering the inspection difficult and sometimes inaccurate.

Thus, in order to remedy the problems and disadvantages of fitting pipe with conventional methods and tools used in fitting pipes and the like the invention herein was conceived and one of its objectives is to provide a pipe fitting tool and method to assist in joining tubular members which is inexpensive to purchase and easy to use by inexperienced persons.

It is still another objective of the present invention to provide a pipe fitting tool for use in uniformly fitting telescoping pipes which includes in one form, a pair of handles, a top jaw having an adjustable ram and a bottom jaw having a stationary punch.

It is a further objective of the present invention to provide another embodiment of the pipe fitting tool in which the upper jaw includes a pair of adjustable rams.

It is still another objective of the present invention to provide a pipe fitting tool and method of use in which a tubular member has a pair of dimples formed therein to assist in joining the tubular member with another tubular member having a different diameter.

It is yet another objective of the present invention to provide a pipe fitting tool having a ram which can be threadably adjusted and secured in place with a lock nut for forming dimples of different heights.

It is a further objective of the present invention to provide a pipe fitting tool which forms a pair of indentations to assist the pipe fitter in forming a secure, uniform joint and to provide an inspector with an easy way to verify proper depth of insertion.

Various other objectives and advantages of the present invention will become apparent to those skilled in the art as a more detailed description is set forth below.

SUMMARY OF THE INVENTION

The aforesaid and other objectives are realized by providing a pipe fitting tool and method to place indentations such as dimples or marks at uniform distances from the edge of a pipe either interiorly or exteriorly thereof to obstruct insertion when one pipe is placed within another. As would be understood, the invention is not limited merely to pipes but includes tubes, conduits, fittings and other tubular members which can be used to form telescopic type joints.

In the preferred embodiment of the tool, a pair of handles having opposing jaws are pivotally joined so the user can grasp and squeeze the handles to thereby close the jaws on the end of a pipe. An adjustable ram is provided with a lock nut on the upper jaw and a rigid punch is provided on the lower jaw whereby squeezing the jaws together causes the wall of the pipe therebetween to form a dimple in the pipe wall as a result of the ram and a smaller indentation or mark on the pipe wall as a result of the punch. While the examples shown provide the ram and punch on different jaws, both the punch and the ram could be placed on only one of the jaws.

In one alternate embodiment of the pipe fitting tool no punch is provided. In another embodiment the ram consists of an allen type set screw.

In another embodiment of the invention a pair of adjustable rams are positioned in the upper jaw and depressions are opposingly defined in the lower jaw. The rams can be adjusted with the use of a conventional allen wrench to vary the depth of the dimples formed in the tubular members.

Each of the tools allow indentations, dimples, marks or the like in the wall of the pipe with the dimple extending exteriorly or interiorly of the pipe. Such dimples limit or block the depth of axial insertion of a smaller pipe while forming the telescopic joint. This limitation ensures a proper, uniform depth of insertion and width or area of brazing for a strong, consistent and durable joint.

The preferred method of the invention utilizes the described tools, the telescoping connection between the pipes and the brazing step.

DETAILED DESCRIPTION OF THE PREFERRED EMBODIMENT AND OPERATION OF THE INVENTION

Figure 1:
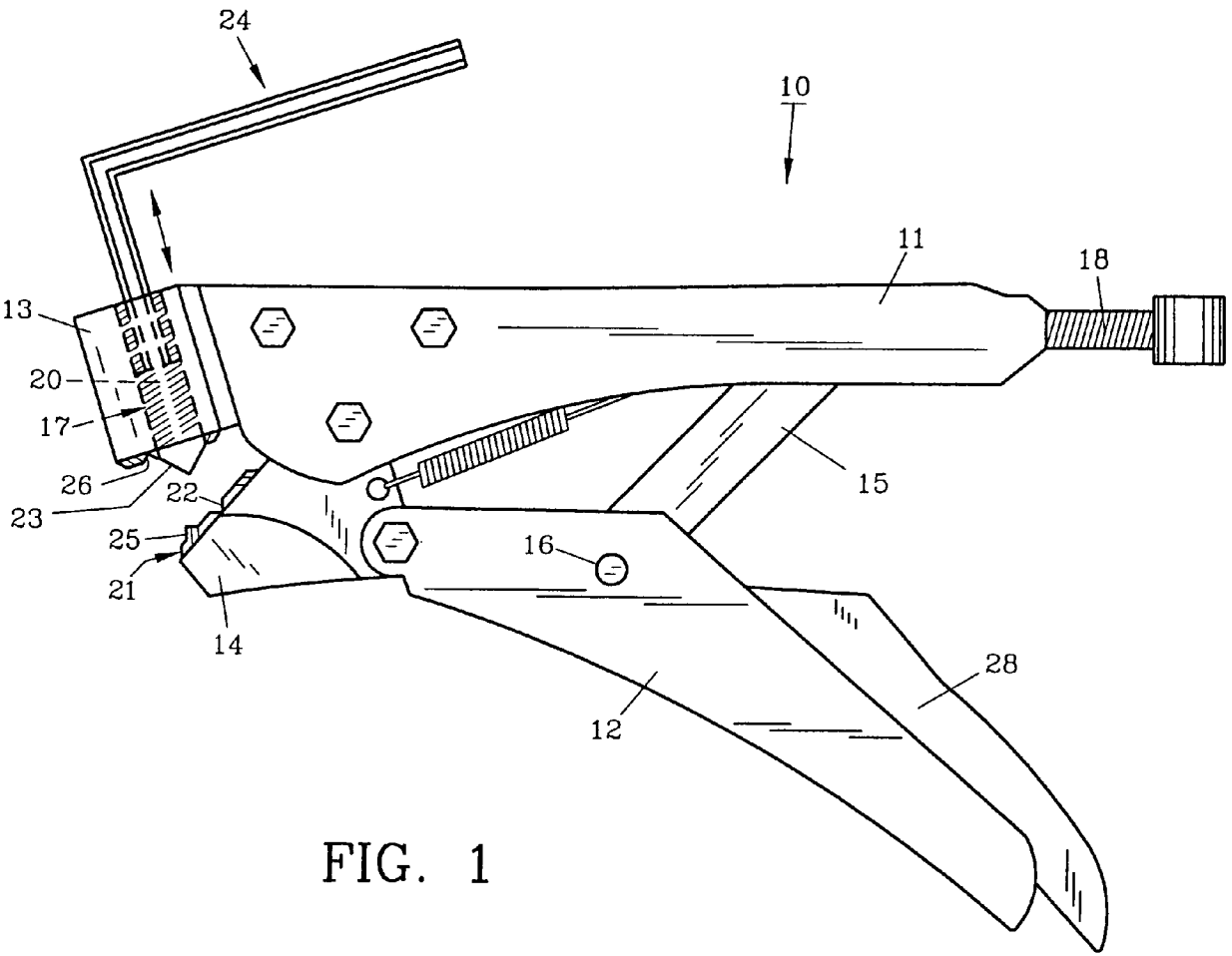
FIG. 1 demonstrates a side elevational view of one embodiment of pipe fitting tool of the invention in an open posture with an alien wrench.

For a better understanding of the invention and its operation, turning now to the drawings, by example FIG. 1 depicts one embodiment of the invention with pipe fitting tool 10 having upper handle 11, lower handle 12, with upper jaw 13 and lower jaw 14 respectively affixed thereto. Upper handle 11 is pivotally joined to lower handle 12 by strut 15. Strut 15 rotates around axle 16 as is standard for "locking jaw" type wrenches such as sold under the "Vice-Grip" name. As is conventional in "Vice-Grip" type wrenches, threaded member 18 is provided for adjusting the space between jaws 13 and 14 when closed. Handle 28 is provided for releasing upper jaw 13 and lower jaw 14 as needed, also conventional in "Vice-Grip" tools.

Upper jaw 13 includes ram 20 which can be extended from or retracted into upper jaw 13, preferably by rotating standard allen wrench 24 which provides a means to adjust ram 20 along threads 17. Allen wrench 24 is removed from ram 20 before pipe fitting tool 10 grasps a pipe for forming a dimple therein. Ram 20 can be extended, preferably to form a dimple about 0.005–0.010 inches (0.127 mm–0.254 mm) in height. Other knob, grips or handles, may likewise be employed to adjust ram 20 which is similar to a common allen screw but with a pointed tip 23. Lower jaw 14 includes platen 21 defining v-shaped groove 22 for receiving ram tip 23 and conically shaped punch 25 received in v-shaped groove 26 as defined in upper jaw 13 when jaws 13, 14 are closed. Punch 25 forms an indentation in a fitting as does ram tip 23, but such indentation is smaller and more shallow, and may be referred to herein as a "mark".

Figure 1A:
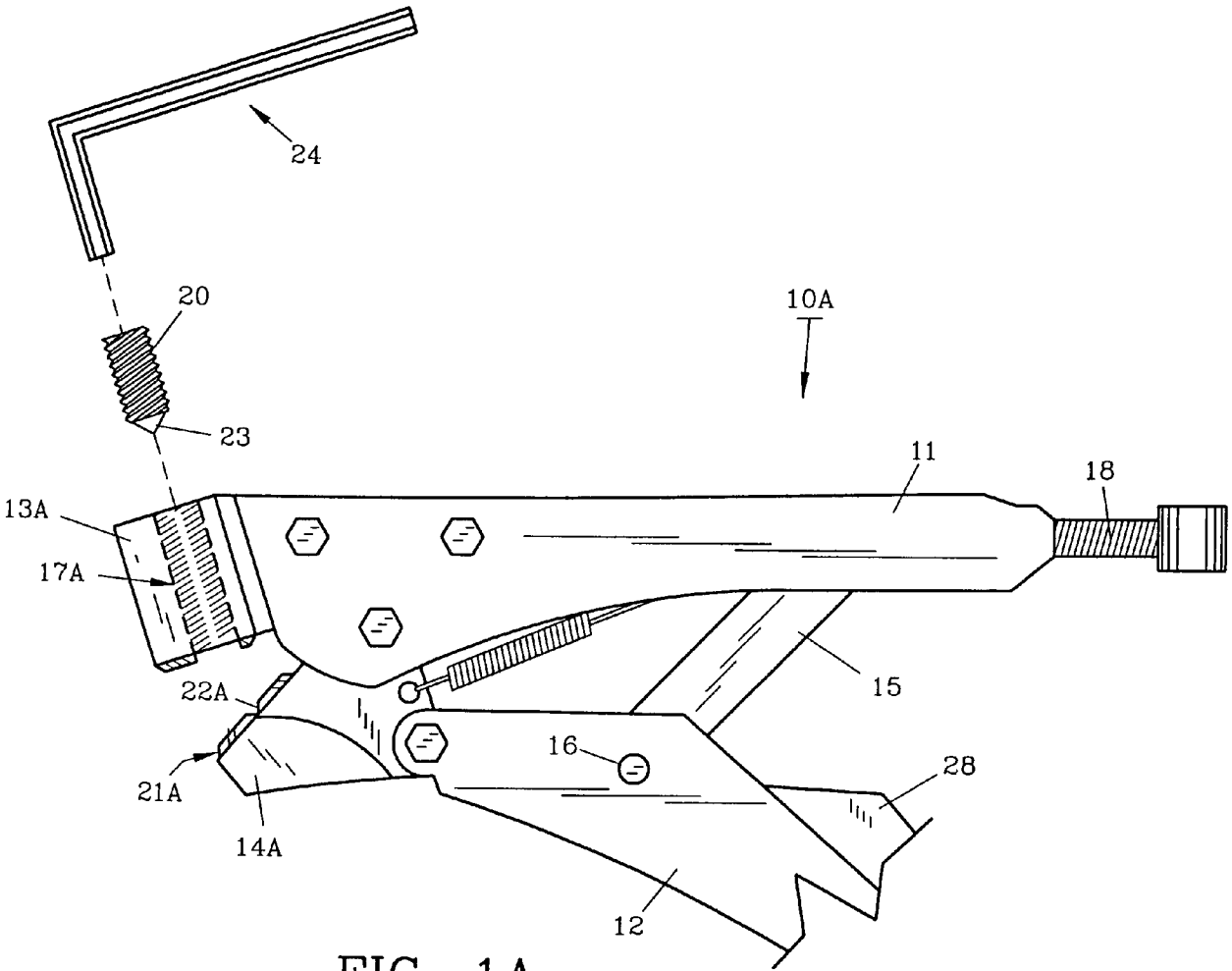
FIG. 1A features an alternate embodiment of the pipe fitting tool as seen in FIG. 1.

In FIG. 1A pipe fitting tool 10A is seen which is similar to preferred pipe fitting tool 10 but does not have punch 25 or groove 26. Tool 10A is seen with ram 20 having a pointed tip 23 and allen wrench 24 exploded therefrom. While allen wrench 24 in addition to providing a convenient means to adjust ram 20, its removability allows for easy use and compact storage of pipe fitting tool 10A. Pipe fitting tool 10A includes upper jaw 13A and lower jaw 14A supporting platen 21A which defines groove 22A. Pipe fitting tool 10A forms a single dimple in a pipe by adjusting ram 20 with allen wrench 24 along threads 17A.

Figure 1C:
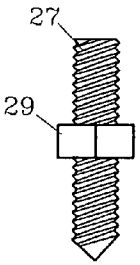
FIG. 1C shows the preferred ram as seen in FIG. 1B removed from the pipe fitting tool jaw.
Figure 1B:
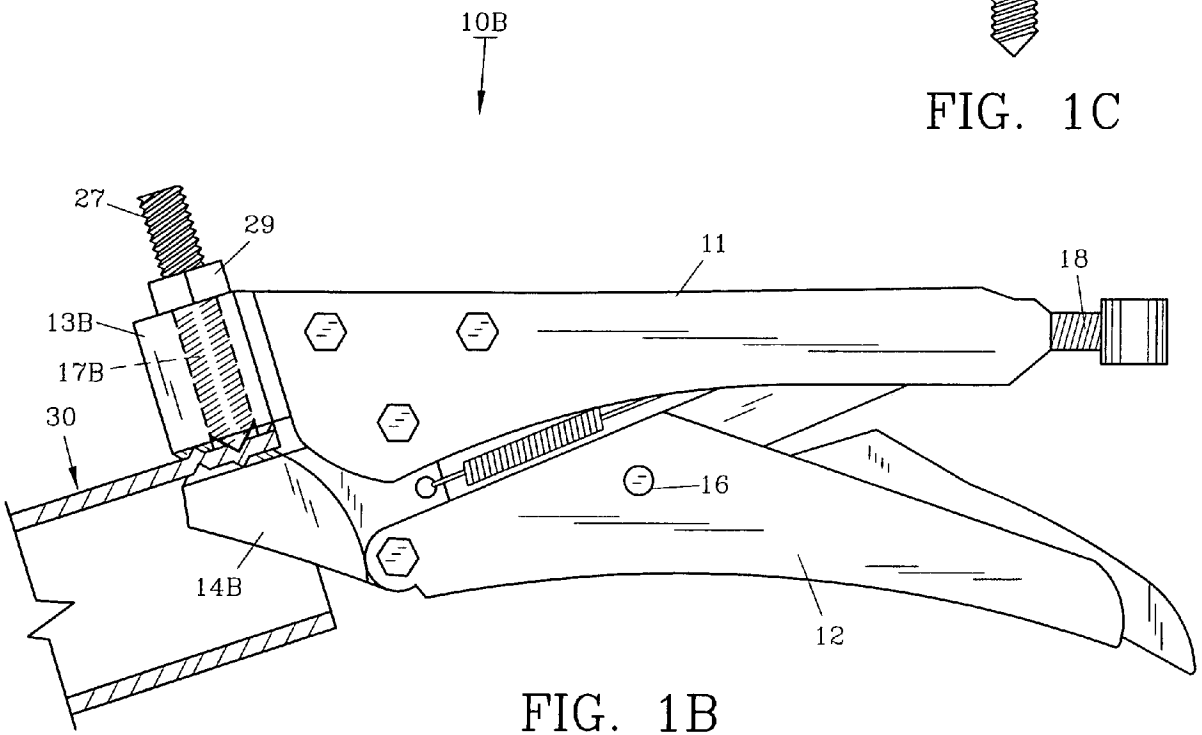
FIG. 1B depicts the preferred form of the pipe fitting tool with a threaded ram and lock nut.

In FIG. 1B preferred pipe fitting tool 10B is shown with member 27 which acts as a ram in upper jaw 13B. Threaded member 27 is adjusted along threads 17B in pipe fitting tool 10B and is secured in place with locking nut 29. Locking nut 29 maintains threaded member 27 at an exact depth within jaw 13B along threads 17B. Lower jaw 14B is also seen in FIG. 1B supporting pipe 30. FIG. 1C shows threaded member 27 removed from jaws 13B, 14B.

Figure 6:
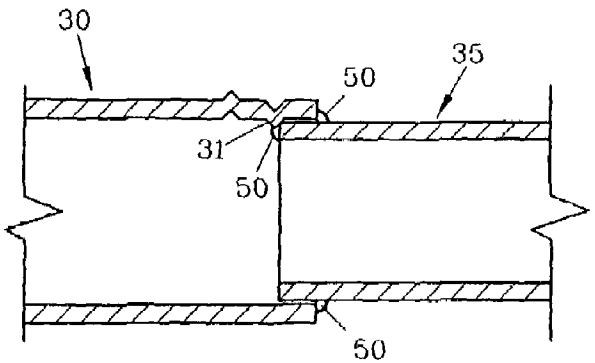
FIG. 6 features a cross-sectional view of a telescopic type joint with one of the tubular members as formed in FIG. 2.

In the preferred method, a typical pipe or other tubular pipe 30 as seen in cross-section in FIG. 1B is placed between jaws 13B, 14B and over lower jaw 14B. Upper handle 11 and lower handle 12 are manually squeezed and are "locked" onto pipe 30 by adjusting threaded member 18. Locking nut 29 has been tightened against the top of jaw 13B thereby forming dimple 31 and mark 32 as shown more clearly in FIG. 3 once jaws 13B, 14B are fully closed. After dimple 31 and mark 32 are formed, handles 11, 12 are opened as usual and pipe 30 is removed therefrom for fitting and brazing with another pipe. In FIG. 6 dimple 31 is shown stopping the penetration of smaller diameter fitting 35 being inserted therein. Thus, dimple 31 formed by the tip of threaded member 27 obstructs the inward direction or path of pipe 35.

Figure 7:
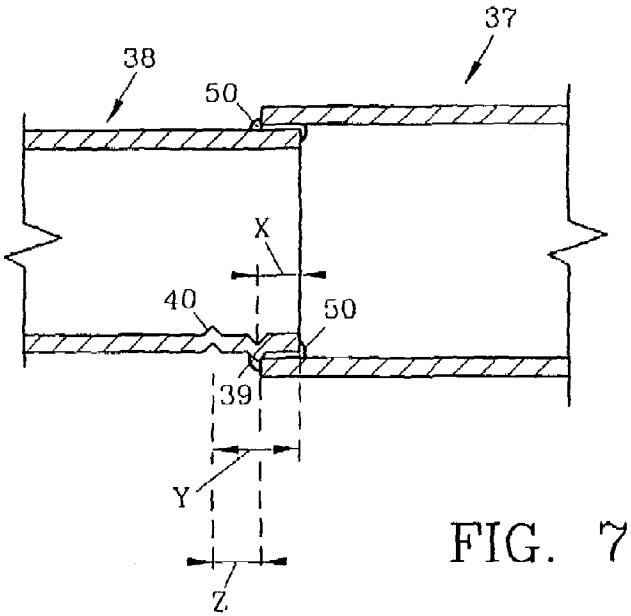
FIG. 7 demonstrates another telescopic type pipe joint with one tubular member dimpled as in FIG. 4.

In FIG. 7 "X" represents the length from dimple 39 to the end of pipe 38. "Y" is the length from dimple 40 to the same end of pipe 38 and is greater than distance "X". Thus:

$$Z=Y-X$$

where Z=distance between dimples.

With X and Y distance known, the preferred distance "Z" between dimples 39 and 40 along pipe 38 for optimum overlap distance "X" by of pipe 37 can be easily calculated.

If, for example pipe 38 having a 2.54 cm outside diameter, Y=10 mm and X=6 mm, then z should measure 4 mm for proper overlap. If Z measures (by the inspector using a ruler) for example 8 mm, then the overlap would be insufficient, causing the pipe to likely fail, and it would not pass inspection. A preset maximum would be based on the "X" and "Y" values for each pipe size and would be available or known by the inspector.

A preset value for safety of pipes 37 and 38 as seen in FIG. 7 would be, for example where Z=5 mm or less, as determined by an on site measurement. The inspector could then pass or fail each joint, depending on its preset overlap value as compared to the actual overlap distance, and no guesswork would be involved. Guess-work has been used heretofore because the overlap length is completely obscured by the fitting into which the smaller pipe is inserted and the braze metal that covers the end of the fitting.

Figure 3:
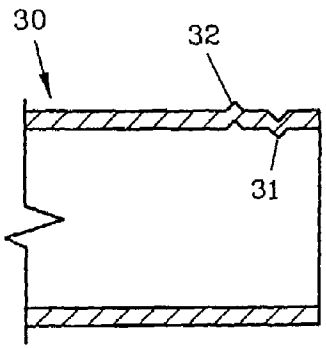
FIG. 3 illustrates the tubular member as removed from the tool seen in FIG. 2.
Figure 2:
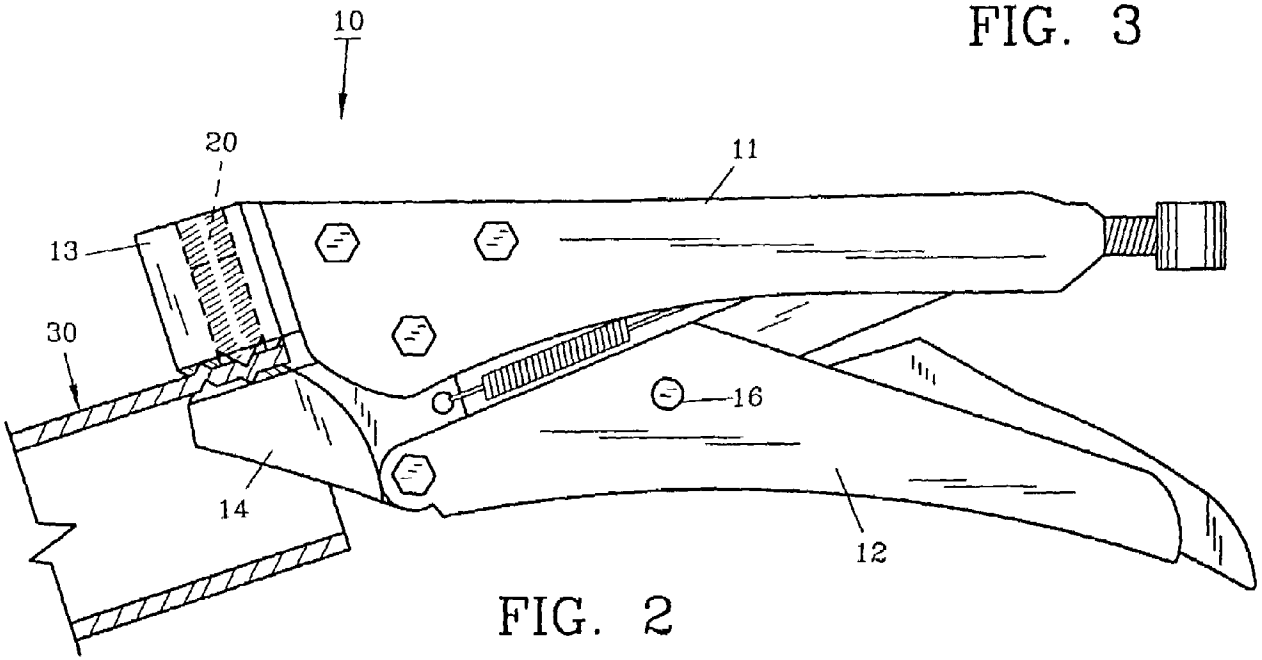
FIG. 2 shows the pipe fitting tool of FIG. 1 in a closed posture with a tubular member between the closed jaws.
Figure 5:
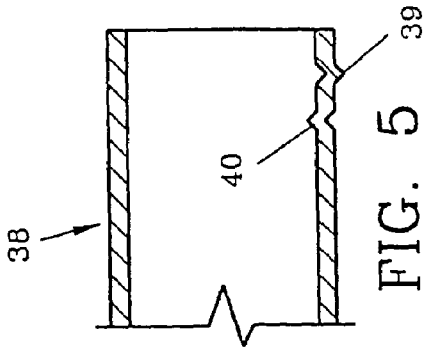
FIG. 5 pictures the tubular member as removed from the tool shown in FIG. 4.
Figure 4:
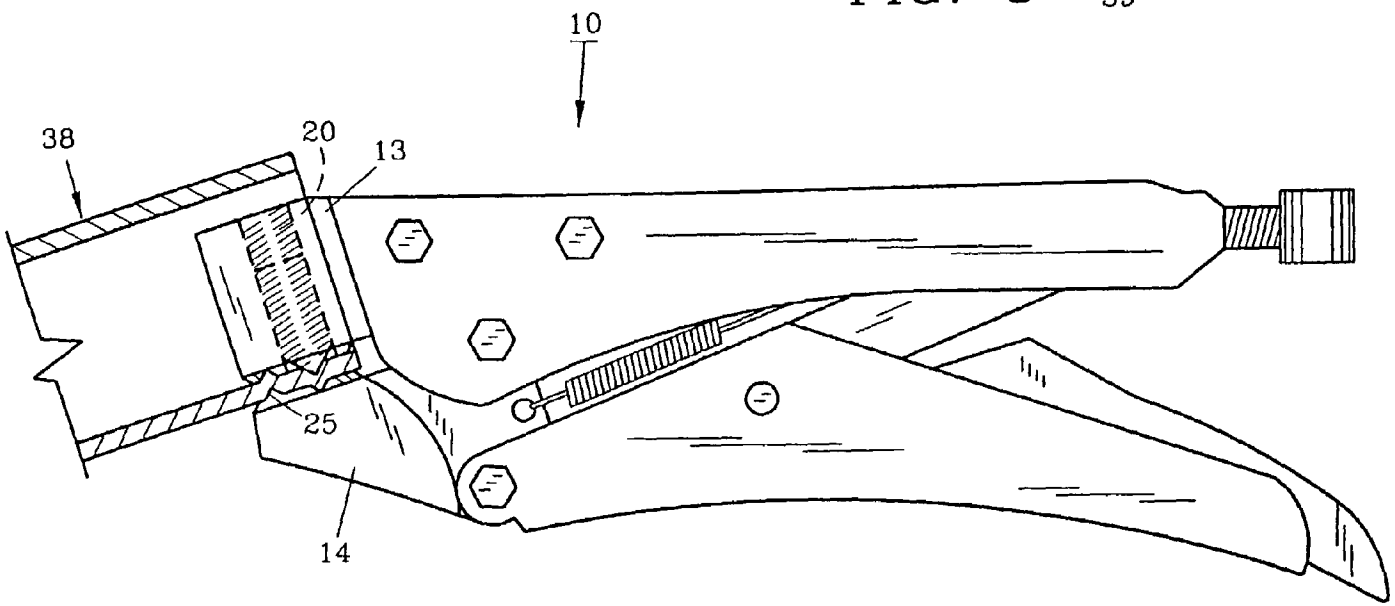
FIG. 4 depicts the tool as seen in FIG. 2 with another tubular member placed over the upper jaw.

In FIG. 4, pipe fitting tool 10 is shown grasping fitting 38. Jaws 13, 14 under pressure cause ram 20 which extends from jaw 13 to form exterior dimple 39 whereas punch 25 forms interior mark 40 shown more clearly in FIG. 5 with fitting 38 removed from tool 10. Shown in FIG. 7, pipe 38 having a diameter smaller than the inner diameter of pipe 37 is placed therein whereby dimple 39 obstructs the path of pipe 37 as it slides over pipe 38. As would be understood, by placing a pipe over upper jaw 13 or over lower jaw 14, a different dimple/mark arrangement is formed, seen for example in FIG. 2 versus FIG. 4 and when comparing pipes produced therefrom as seen by pipes 30 and 38, (FIGS. 3 and 5).

By allowing pipes 30, 35, 37 and 38 to be uniformly assembled to the same axial depth, greater integrity is provided during the brazing operation whereby braze metal 50 is deposited between the outer and inner surfaces of the overlapping or telescoping pipes as shown in FIGS. 6 and 7 in a consistent manner.

Figure 9:
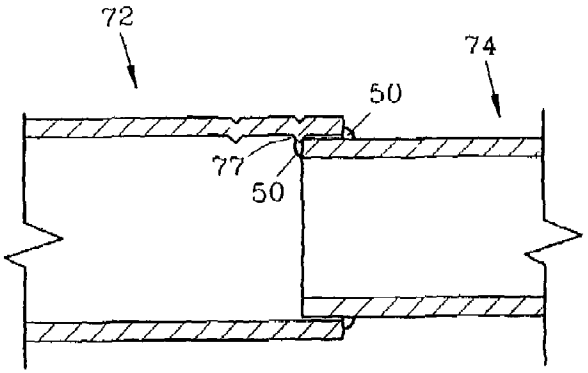
FIG. 9 illustrates yet another telescopic type joint as formed by the tool in FIG. 8.
Figure 14:
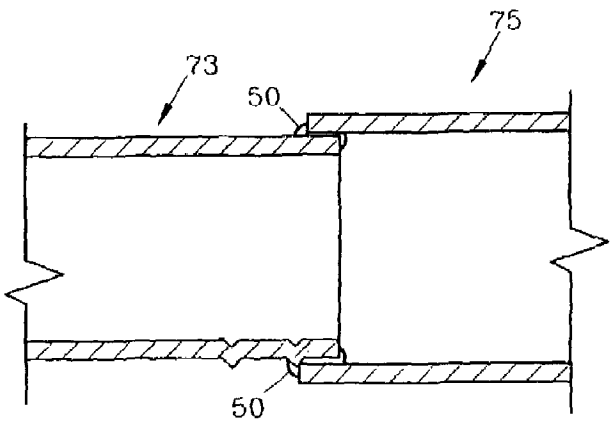
FIG. 14 features another telescopic type joint formed with the pipe of FIG. 13.
Figure 8:
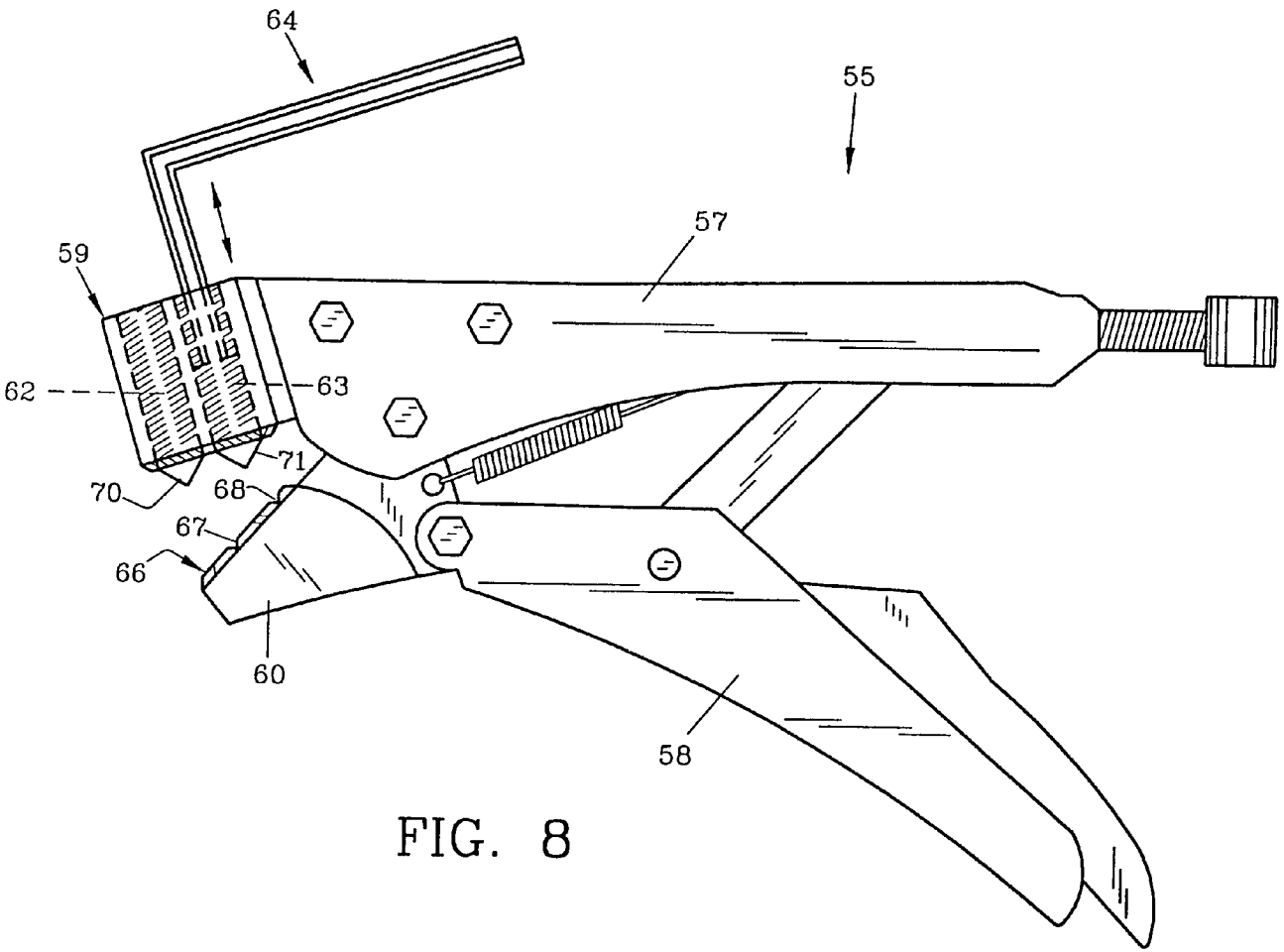
FIG. 8 depicts an alternate embodiment of the tool as shown in FIG. 1.
Figures 10, 12:
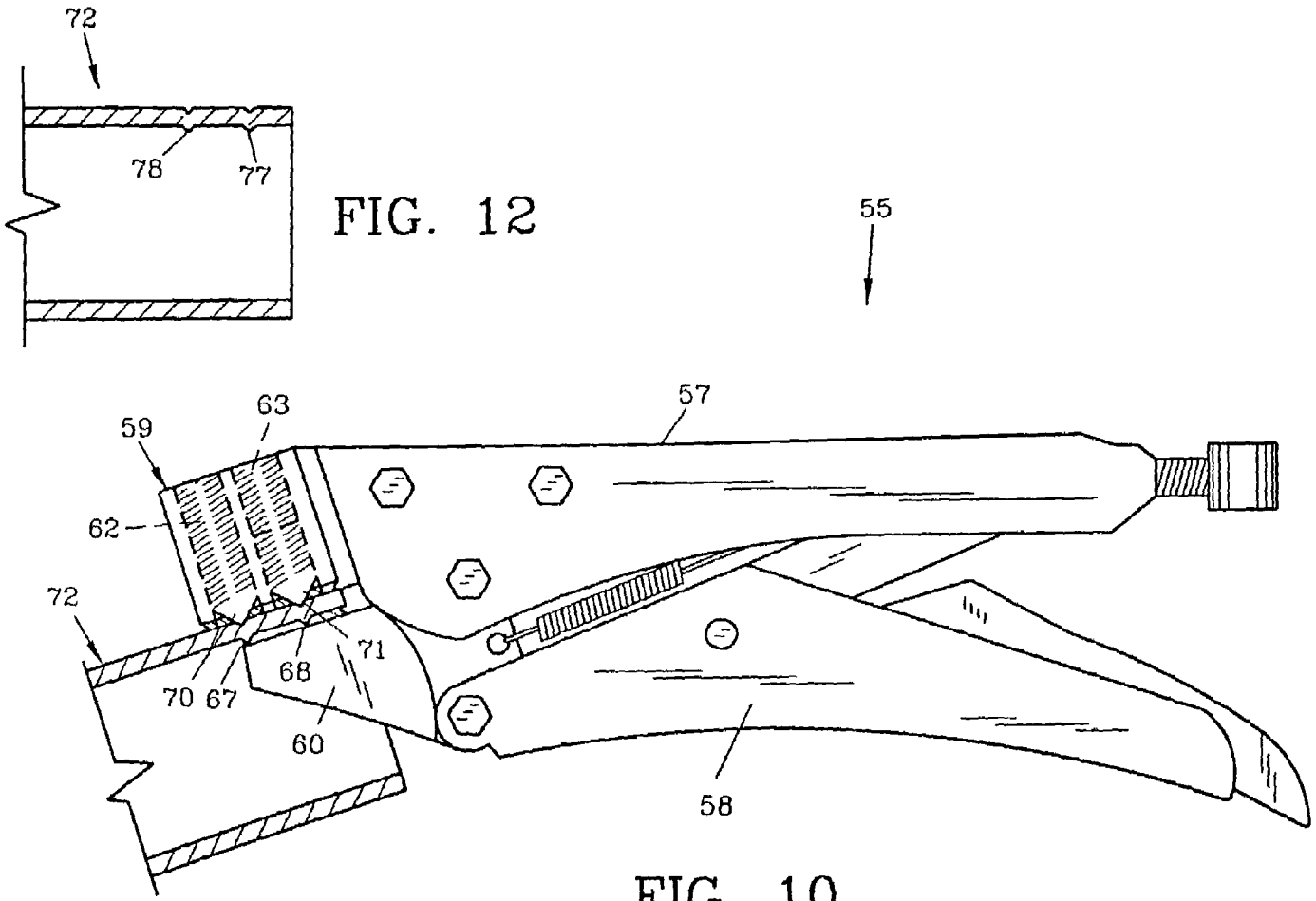
FIG. 10 pictures the tool as shown in FIG. 8 in a closed configuration with a pipe positioned over the lower jaw.
FIG. 12 demonstrates a tubular member as removed from the tool of FIG. 10.
Figure 13:
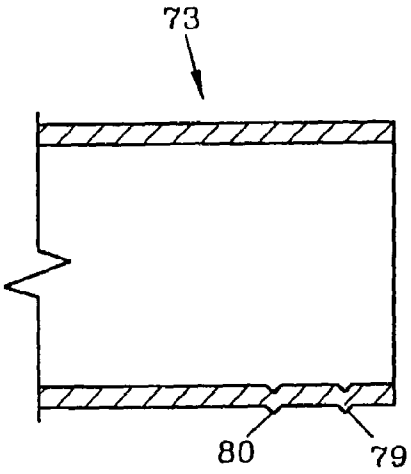
FIG. 13 illustrates the pipe as shown in FIG. 11 removed from the jaws.
Figure 11:
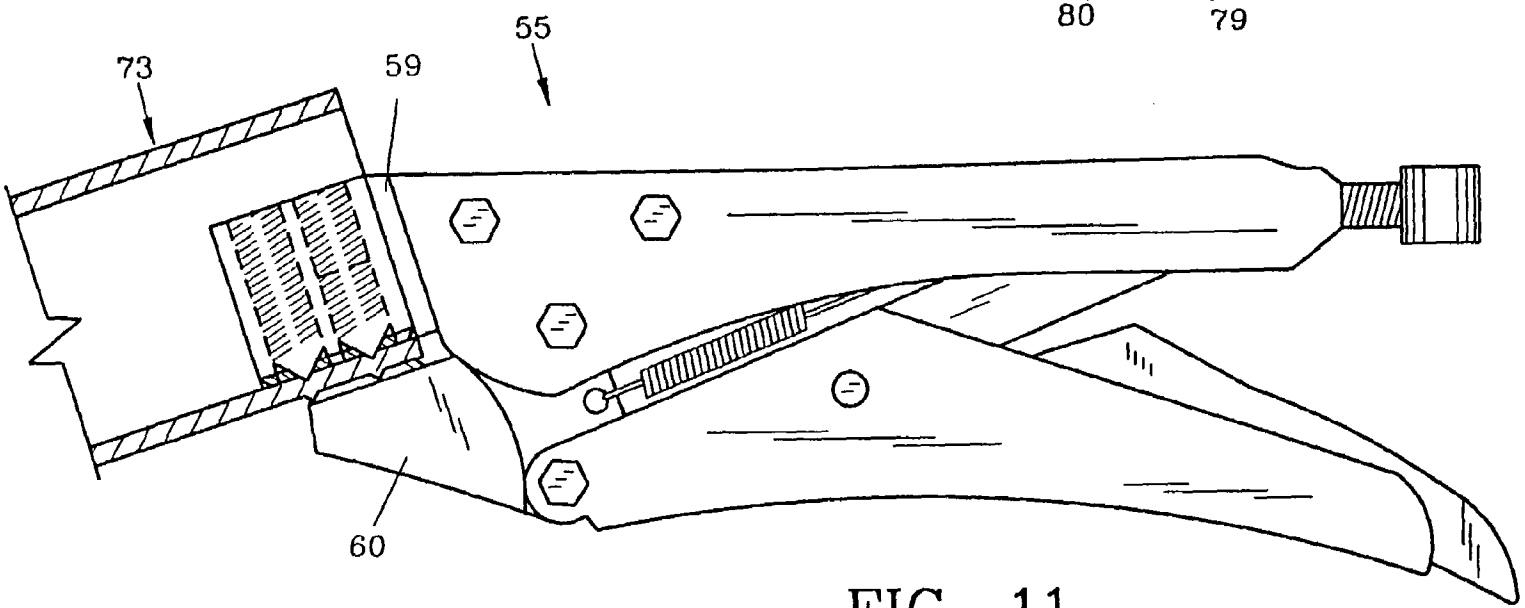
FIG. 11 shows the tool as shown in FIG. 10 with a pipe positioned over the upper jaw.

In FIG. 8, another alternate embodiment of pipe fitting tool 55 is shown having upper handle 57 and lower handle 58. Upper jaw 59 is joined to upper handle 57 whereas lower jaw 60 is joined to lower handle 58. Upper jaw 59 includes a pair of rams 62, 63 which can be adjusted to a suitable depth by allen wrench 64. Platen 66 on lower jaw 60 defines grooves 67, 68 for receiving respectively tips 70, 71 of rams 62, 63. In FIG. 10 fitting tool 55 is shown gripping fitting 72 which is placed over lower jaw 60. Fitting 72 is shown removed from tool 55 in FIG. 12 having interior outer dimple 77 and interior inner dimple 78. Shown in FIG. 9, fitting 72 is shown whereby dimple 77 obstructs fitting 74 from further insertion therein. In FIG. 11 tool 55 is shown gripping pipe 73 placed over upper jaw 59 and pipe 73 is seen removed therefrom in FIG. 13 for clarity. Tool 55 forms exterior outer dimple 79 and exterior inner dimple 80 therein. In FIG. 14, pipe 73 is shown joined to larger diameter pipe 75.

Thus as shown, dimples and/or marks can be formed in various pipes to assist in strong, uniform assembly and brazing with other pipes or tubular members. In addition to the uniform insertion, the dimples/marks provide an indicator along the outer circumference of such pipes or tubular members for clear viewing and precise assembly and brazing.

The illustrations and examples provided herein are for explanatory purposes and are not intended to limit the scope of the appended claims.

I claim:

1. A tool for use in fitting pipes comprising: an upper handle, a lower handle, said upper handle pivotally joined to said lower handle, an upper jaw, said upper jaw attached to said upper handle, a lower jaw, said lower jaw attached to said lower handle, an adjustable ram, said ram affixed to said upper jaw, said ram defining a tip, said ram tip projecting from said upper jaw towards said lower jaw, a means to adjust said ram, said adjusting means removable from said ram, said lower jaw defining a depression opposite said ram, said depression shaped complementary to said ram tip, a punch, said punch affixed to said lower jaw proximate said depression whereby pivoting said handles to close said jaws on an item therebetween allows said ram and said depression to form a dimple on said item that extends from said ram tip and projects into said depression while said punch forms a mark on the item.

2. The tool of claim 1 wherein said ram is threadably affixed to said upper jaw.

3. The tool of claim 1 further comprising a lock nut, said lock nut affixed to said ram.

4. The tool of claim 1 wherein said adjusting means comprises a wrench, a threaded member, said threaded member attached to said upper handle, and said depression is V-shaped.

5. The tool of claim 1 wherein said upper and lower handles are joined to lock onto an item placed between said jaws.

6. A method of forming dimples in tubular member with a tool having a pair of pivotally attached handles with opposing jaws, an adjustable ram attached to the jaw of one handle and a punch attached to the jaw of the other handle, and a means to adjust the ram, comprising the steps of:

a) placing one of the jaws along the inside of the tubular member with the other jaw outside the tubular member;

b) adjusting the ram; and c) pivoting the jaws against the tubular member to form a dimple with said ram while forming a mark with said punch on the tubular member.

7. The method of claim 6 wherein pivoting the jaws comprises the step of forming a dimple extending in a different direction from said mark.

8. The method of claim 6 wherein adjusting the ram includes the step of locking the ram in place.

9. The method of claim 8 wherein adjusting the ram comprises the step of locking the ram using a lock nut.

10. The method of claim 6 wherein pivoting the jaws comprises the step of receiving the dimple in the depression.

* * * * *